US007677307B2

(12) United States Patent
Vasques et al.

(10) Patent No.: US 7,677,307 B2
(45) Date of Patent: Mar. 16, 2010

(54) APPARATUS AND METHODS TO REMOVE IMPURITIES AT A SENSOR IN A DOWNHOLE TOOL

(75) Inventors: Ricardo Vasques, Sugar Land, TX (US); Peter S. Hegeman, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 261 days.

(21) Appl. No.: 11/757,476

(22) Filed: Jun. 4, 2007

(65) Prior Publication Data

US 2008/0093078 A1 Apr. 24, 2008

Related U.S. Application Data

(60) Provisional application No. 60/852,518, filed on Oct. 18, 2006.

(51) Int. Cl.
*E21B 21/00* (2006.01)

(52) U.S. Cl. ..... 166/264; 166/311; 166/250.01; 166/373

(58) Field of Classification Search ..... 166/311, 166/250.01, 373, 264
See application file for complete search history.

(56) References Cited

U.S. PATENT DOCUMENTS

| | | | |
|---|---|---|---|
| 3,813,936 | A | 6/1974 | Urbanosky et al. |
| 4,936,139 | A | 6/1990 | Zimmerman et al. |
| 5,269,180 | A | 12/1993 | Dave et al. |
| 6,218,662 | B1 | 4/2001 | Tchakarov et al. |
| 6,301,959 | B1 | 10/2001 | Hrametz et al. |
| 6,437,326 | B1 | 8/2002 | Yamate et al. |
| 6,478,950 | B1 | 11/2002 | Peat et al. |
| 6,585,045 | B2 | 7/2003 | Lee et al. |
| 6,609,568 | B2 | 8/2003 | Krueger et al. |
| 6,719,049 | B2 | 4/2004 | Sherwood et al. |
| 6,755,079 | B1 | 6/2004 | Proett et al. |
| 2002/0084072 | A1 | 7/2002 | Bolze et al. |
| 2004/0000433 | A1 | 1/2004 | Hill et al. |
| 2005/0279499 | A1 | 12/2005 | Tarvin et al. |

FOREIGN PATENT DOCUMENTS

GB 2368391 1/2002

*Primary Examiner*—Jennifer H Gay
*Assistant Examiner*—Nicole A Coy
(74) *Attorney, Agent, or Firm*—Dave R. Hofman

(57) ABSTRACT

Apparatus and methods to remove impurities at a sensor in a downhole tool are disclosed. During the testing and/or sampling of formation fluid in a borehole, the downhole tool creates a transient high rate of fluid flow of the formation fluid to remove impurities at the sensor.

4 Claims, 6 Drawing Sheets

APPARATUS AND METHODS TO REMOVE IMPURITIES AT A SENSOR IN A DOWNHOLE TOOL

RELATED APPLICATION

This patent application claims priority pursuant to 35 U.S.C. §119 of U.S. Provisional Patent Application Ser. No. 60/852,518 filed on Oct. 18, 2006, hereby incorporated by reference in its entirety.

FIELD OF THE DISCLOSURE

This disclosure relates generally to apparatus and methods to remove impurities at a sensor in a downhole tool and, more particularly, to removing impurities at a sensor during the testing and/or sampling of formation fluid by the downhole tool in a wellbore.

BACKGROUND

Typically, drilling rigs at the surface are used to drill boreholes to reach the location of subsurface oil or gas deposits and establish fluid communication between the deposits and the surface via the borehole. Downhole drilling equipment may be directed or steered to the oil or gas deposits using well-known directional drilling techniques. The drilling equipment has a drill bit through which mud is pumped during drilling to cool the drill bit, carry away the cuttings, and maintain a pressure in the borehole greater than the fluid pressure in the subterranean formations surrounding the borehole. The drilling mud also forms a mud cake that lines the borehole.

During the drilling, it is advantageous to perform evaluations of the subterranean formations penetrated by the borehole. The drilling equipment may be removed and a wire line downhole tool deployed into the borehole to test and/or sample one or more formation fluids at various stations or positions of the wire line tool. Alternatively, the drilling equipment of a drill string may include a downhole tool to test and/or sample the fluids of the surrounding subterranean formation. The testing and/or sampling may be accomplished by a variety of formation testing tools that retrieve the formation fluids at desired borehole positions or stations, test the retrieved fluids to ensure that the retrieved fluids are substantially free of mud filtrates, and collect such fluids in one or more chambers associated with a downhole tool. The fluid samples obtained from the subterranean formations are brought to the surface and evaluated to determine the properties of the fluids and the condition of the subterranean formations, and thereby locate oil and gas deposits.

The testing and/or sampling of formation fluids has been accomplished by wire line tools or drilling equipment that include a fluid sampling probe. The fluid sampling probe may include a durable rubber pad that is mechanically pressed against the borehole wall to form a hydraulic seal. The probe may be connected to a chamber that is connected to a pump that operates to lower the pressure in the probe. When the pump lowers the pressure in the probe below the pressure of the formation fluids, the formation fluids are drawn through the probe and into the wire line or drilling equipment downhole tool to flush the formation fluids prior to the testing and/or sampling.

During the testing and/or sampling of the formation fluids, it is important that sensors in the wire line or the drilling equipment downhole tool provide accurate measurements. Typically, the formation fluids contain impurities such as, for example, drilling fluids, cuttings, mud, or different subterranean fluids. Such impurities can affect significantly the operation of the sensors of the downhole tool and result in inaccurate measurements during the testing and/or sampling of the subterranean formation fluids.

SUMMARY OF THE DISCLOSURE in accordance with one example, a method to remove impurities of a formation fluid at a sensor located in a downhole tool positioned in a wellbore penetrating a subterranean formation includes providing in a wellbore a downhole tool having a sensor in a flow line of the tool, and a flow valve in the flow line. The flow valve is opened to create a transient high flow rate of a formation fluid to remove impurities at the sensor.

In accordance with another example, apparatus to remove impurities of a formation fluid at a sensor located in a downhole tool positioned in a wellbore penetrating a subterranean formation, comprise a downhole tool for a wellbore and having a sensor in a flow line of the tool. A flow valve for the flow line may be opened to create a transient high flow rate of a formation fluid to remove impurities at the sensor.

DETAILED DESCRIPTION

In general, the example apparatus and methods described herein to clean or remove impurities at a sensor in a downhole tool may be utilized in various types of drilling operations to test and/or collect uncontaminated formation fluids for evaluation. Additionally, while the examples are described in connection with drilling operations for the oil and gas industry, the examples described herein may be more generally applicable to a variety of drilling operations for different purposes.

Figure 1:
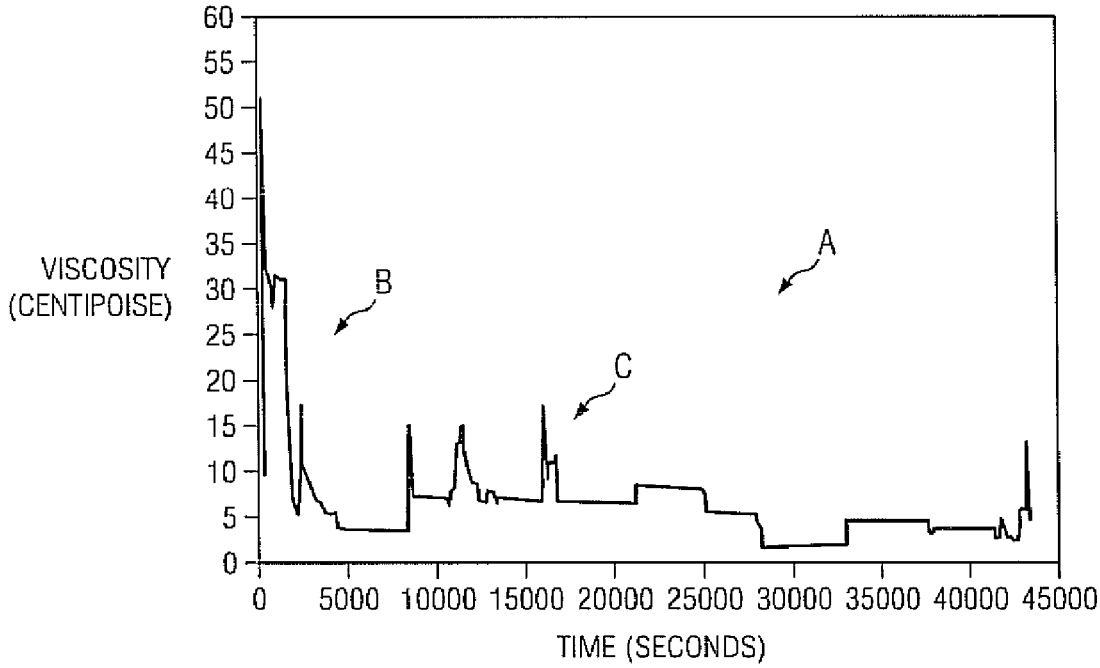
FIG. 1 (PRIOR ART)
FIG. 1 is a chart illustrating the test results of a fluid viscometer used for water testing in a downhole tool.

A sensor that provides accurate measurements in a laboratory environment may provide less accurate measurements when the sensor is located in a downhole environment. A challenge of conducting downhole testing and/or sampling is to ensure that a sensor in a downhole tool is free of impurities typically contained in formation fluid samples. Such impurities may include drilling fluids, cuttings, mud, or different subterranean reservoir fluids (e.g., water, oil, or gas). Thus, the impurities can reduce substantially the accuracy of the measurements of the downhole sensor and decrease the value of conducting such testing and/or sampling. The chart of FIG. 1 illustrates the known effect of a downhole environment upon the water sample measurements of a downhole fluid viscometer. The downhole fluid viscometer has an accuracy range of approximately ten percent under laboratory conditions. In the chart of FIG. 1, the curve A includes viscosity measurements that correspond to changes in the speed of a downhole pump of the downhole tool. The portion B of the curve A shows relatively large fluctuations in the magnitude of the measured viscosity. In a similar manner, a portion C of the curve A shows significant fluctuations in the measured viscosity. It was determined that the flow rate of the formation fluid (water) transmitted by the pump of the downhole tool was insufficient to clean impurities from the measurement surfaces of the downhole fluid viscometer. The impurities present in the water sample caused the downhole fluid viscometer to produce inaccurate measurements. Generally, the flow rate of a downhole pump of a downhole tool is limited mainly by the mobility of the formation fluid being pumped, the area of an opening through which the formation fluid flows, and the maximum pressure differential permitted to prevent the pressure of the pumped formation fluid from dropping below the saturation pressure and resulting in either the tool becoming plugged or a loss of the borehole seal at the probe.

Figure 2:
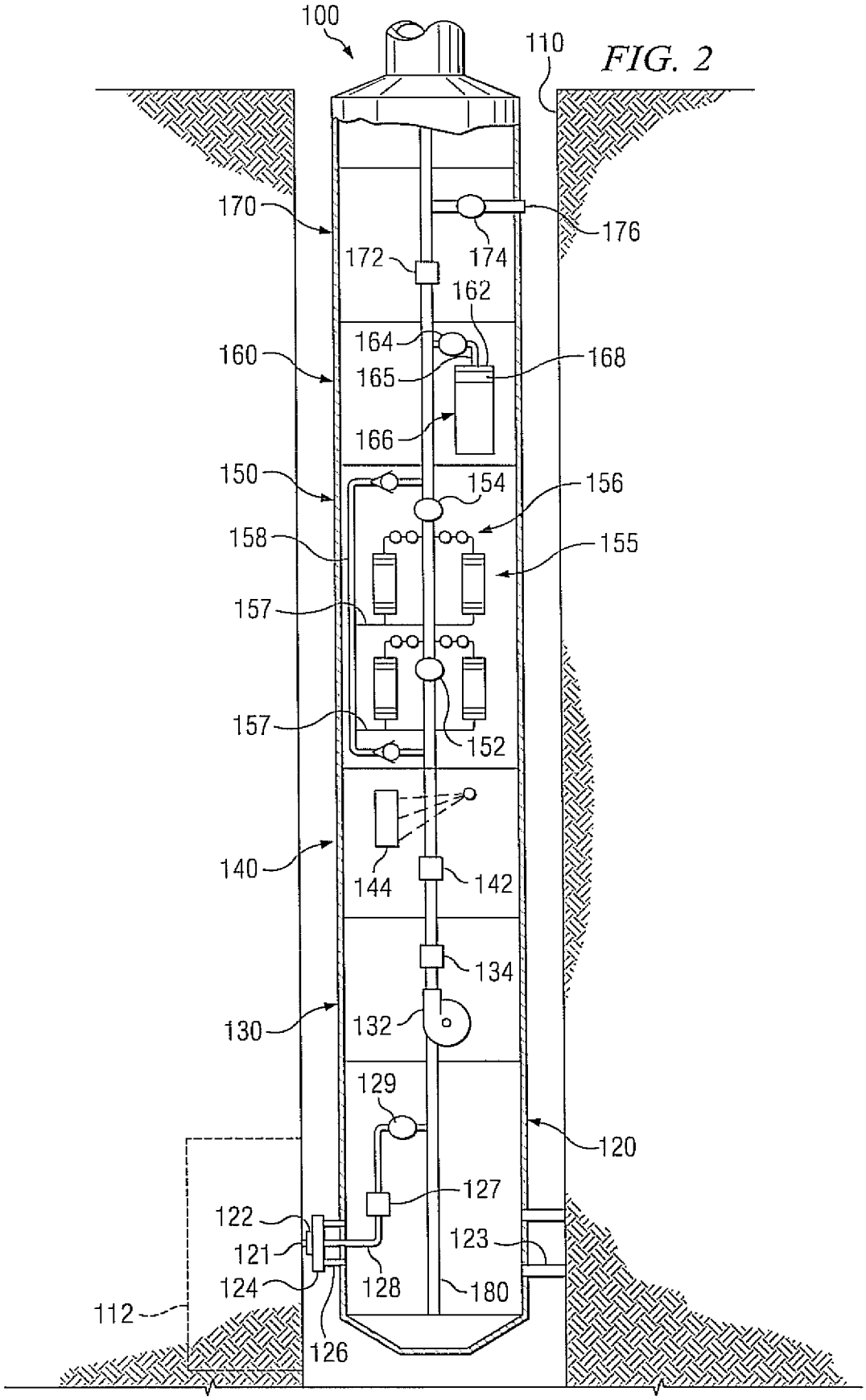
FIG. 2 is a schematic illustration of an example downhole tool that includes apparatus to test and/or sample surrounding subterranean formation fluids.

FIG. 2 is a schematic illustration of an example downhole tool 100 that includes apparatus to test and/or sample surrounding subterranean formation fluids in a borehole 110. The example downhole tool 100 may be a wire line tool or part of the drilling equipment of a drill string. The example downhole tool 100 is illustrated schematically as located in the borehole 110 and a probe 121 is deployed to collect a formation fluid sample at a subterranean formation station or position 122. The example downhole tool 100 includes a flow line 180 passing through several modules of apparatus such as, for example, a probe module 120, a hydraulic power module 130, a fluid analyzer module 140, a multi-sample module 150, a large sample chamber module 160, and a pump-out module 170. The modules 120, 130, 140, 150, 160 and 170 may be arranged in different positions relative to one another in the example downhole tool 100.

The probe module 120 includes a pair of backup pistons 123 shown in an extended mode to engage the borehole 110 when the probe 121 also is extended to engage the borehole 110. The probe 121 includes a seal or packer 122, a platform 124, one or more pistons 126 and a probe flow line 128. The probe flow line 128 is connected to the flow line 180 and includes a pressure sensor 127 and a valve 129 shown in an open mode to block fluid flow.

The hydraulic power module 130 is located above the probe module 120 and includes a hydraulic pump 132 and a flow line sensor 134 to displace fluid and provide information on the flow rate of the fluid in the flow line 180. The fluid analyzer module 140 is adjacent the hydraulic power module 130 and contains another flow line sensor 142 and a fluid sensor or analyzer 144. Although illustrated as having an optical emitter and a receiver, the fluid sensor 144 may be any of numerous types of sensors such as, for example, a viscometer to measure the viscosity of fluid samples, or a spectrometer to determine the density of fluid samples.

The multi-sample module 150 is located adjacent the fluid analyzer module 140. The multi-sample module 150 includes isolation valves 152 and 154 in the flow line 180 and a plurality of low-pressure sample chambers 155 connected via flow valves or exo-valves 156 and connecting flow lines 157 and 158 to the flow line 180.

The flow line 180 continues through the large sample chamber module 160 that includes a large volume sample chamber 162 and an isolation or flow valve 164, and through a pump-out module 170 containing yet another flow line sensor 172, to an outlet or flow valve 174 and an outlet port 176.

The example downhole tool 100 is illustrated as having the flow line sensors 134, 142, 172 and the fluid sensor 144 at certain locations. However, such locations are just illustrative examples of the locations and types of sensors that may be contained within the example downhole tool 100. It is contemplated that numerous types of sensors to monitor parameters such as, for example, viscosity, density or flow, may be located and operated in numerous arrangements within the example downhole tool 100 during the testing an/or sampling of formation fluids at various subterranean formation stations in the borehole 110.

Figure 3:
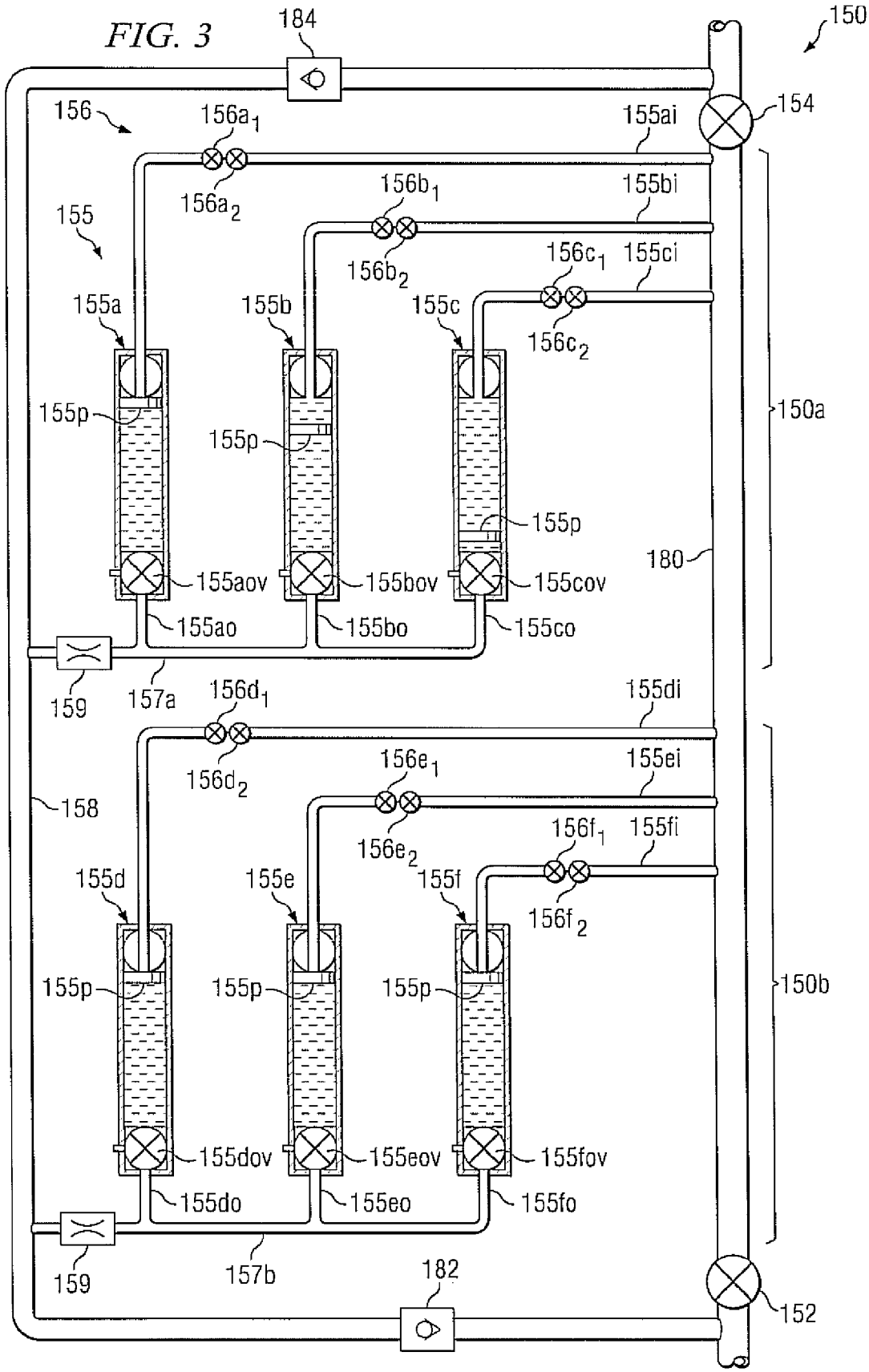
FIG. 3 is an enlarged illustration of the multi-sample module of the example downhole tool illustrated in FIG. 2.

FIG. 3 is an enlarged illustration of the multi-sample module 150 of the downhole example downhole tool 100 illustrated in FIG. 2. The flow line 180 communicates with the connecting flow line 158 that includes check valves 182 and 184 to permit fluid to flow and bypass the low-pressure chambers 155. Branching off the connecting flow line 158 are connecting lines 157*a* and 157*b*, which connect the outlet ends of sample chambers 155 to the flow line 158. Each of the connecting lines 157*a* and 157*b* includes a flow restriction 159. The sample chambers 155 comprise individual sample chambers 155*a*, 155*b*, and 155*c* in an upper portion 150*a* of the multi-sample module 150, and individual sample chambers 155*d*, 155*e*, and 155*f* in a lower portion 150*b* of the multi-sample module 150. Each sample chamber 155*a-f* has both a respective in-flow line (e.g., 155*ai*, 155*bi*, 155*ci*, etc.) and an out-flow line (e.g., 155*ao*, 155*bo*, 155*co*, etc.) wherein the outflow lines 155*ao-co* communicate with the connecting line 157*a* and the outflow lines 155*do-fo* communicate with the connecting line 157*b*. Each in-flow line 155*ai-fi* includes a respective pair of electrically operated flow valves or exo-valves 156 (e.g., 156$a_1$ and 156$a_2$, 156$b_1$ and 156$b_2$, 156$c_1$ and 156$c_2$, etc.). The flow valves 156 are electronically-operated valves which, when activated, change position from open to closed or closed to open. Alternatively, other types of flow valves having more functional capabilities may be utilized in the multi-sample module 150. An out-flow valve 155*aov-fov* is located at the bottom of each sample chamber 155*a-f* and communicates the interior of the respective sample chamber 155*a-f* with wellbore fluid within the multi-sample module 150.

Each sample chamber 155*a-f* includes a piston 155*p*. On a side adjacent an associated in-flow line 155*ai-fi*, each piston 155*p* has a pressure (e.g., such as atmospheric pressure) significantly lower than the pressure of the formation fluid present at the station 112. At an opposite lower side of each piston 155*p*, water or any other appropriate fluid is contained within the associated sample chamber 155*a-f*.

The example downhole tool 100 may be operated to clean one or more of the sensors 134, 142, 144 and 172 and to retain a sample of the formation fluid in one or more selected sample chambers 155*a-f*. At the probe module 120, the back-up pistons 123 and the probe 121 are deployed, the valve 129 is opened and the hydraulic pump 132 then operated to transmit formation fluid through the flow line 180 to the outlet port 176 and out into the borehole 110. When testing of a formation fluid in the borehole 110 is to be conducted and/or a sample to be obtained and retained in a sample chamber 155*a-f* of the multi-sample module 150, the hydraulic pump 132 ceases operation and the isolation valve 154 is closed (see FIGS. 2 & 3). The closure of the isolation valve 154 stops the unrestricted flow of formation fluid directly through the flow line 180 to the outlet port 176 and the borehole 110, and selects the flow line sensors 132 and 134 and the fluid sensor 144 to be cleaned. The formation fluid in the flow line 180 below the isolation valve 154 will flow upwardly to either the upper portion 150*a* or the lower portion 150*b* of the multi-sample module 150. The formation fluid can flow through any of the in-flow lines 155*ai-fi* to an associated sample chamber 155*a-f*.

Referring to the upper portion 150*a* of the multi-sample module 150 in FIG. 3, the illustrated operational modes of the individual sample chambers 155*a*, 155*b* and 155*c* will be utilized to show how one sample chamber may be used to clean a sensor in the example downhole tool 100 during a testing and/or sampling of formation fluid at the station 112 of the borehole 110. For example, the sample chamber 155*a* is in an unused mode whereby the piston 155*p* is located adjacent the top of the sample chamber 155*a*, and a low pressure fluid (e.g., air) is present between the piston 155*p* and the tool of the sample chamber while fluid such as, for example, water is located within the sample chamber 155*a* below the piston 155*p*. The exo-valve 156$a_1$ in the in-flow line 155*ai* is in a closed position and the exo-valve 156$a_2$ is in an open position. When the exo-valve 156$a_1$ has opened, formation fluid will flow into the sample chamber 155*a*. This operation is illustrated by the sample chamber 155*b* which has just been activated whereby the exo-valve 156$b_1$ in the in-flow line 155*bi* has been opened so that the formation fluid (which is at a considerably higher pressure of several thousand pounds per square inch (psi) for surface wells and up to 35,000 psi for deep wells) has displaced the piston 155*p* slightly downwardly in the sample chamber 155*b*. when the exo-valve 156$b_1$ is opened, the low-pressure fluid above the piston 155*p* is rapidly compressed due to the much greater pressure of the formation fluid. The opening of the exo-valve 156$b_1$ initially creates a transient high flow rate of formation fluid across or at the selected flow line sensors 134 and 142 and the selected fluid sensor 144 in the flow line 180. The transient high flow rate of formation fluid cleans or removes contaminants such as impurities from the sensing surfaces (not shown) of the selected sensors 134, 142 and 144 to enable more accurate measurements of the formation fluid.

Although the opening of the exo-valve 156$b_1$ initially creates a transient high flow rate of formation fluid across the selected sensors 134, 142 and 144, the compression of the low-pressure fluid above the piston 155*p* in the sample chamber 155*b* results in a diversion of a small volume of formation fluid into the sample chamber 155*b*. After the initial compression of the low-pressure fluid by the formation fluid above the piston 155*p*, the fluid on the other side of the piston 155*p* flows through the out-flow valve 155*bov* to the wellbore fluid located around the sample chambers 155. Thus, after the initial opening of the exo-valve 156$b_1$ the formation fluid that subsequently fills the sample chamber 155*b* is not affected by the initial transient high flow rte of formation fluid and is representative of the formation fluid being sampled at the subterranean formation station 112.

When the sample chamber 155*b* is filled with sampled formation fluid, the exo-valve 156$b_2$ is closed to isolate the sample chamber 155*b* and retain the formation fluid sample. This is illustrated in FIG. 3 by the sample chamber 155*c*, which contains a sample of formation fluid contained or captured between the closed exo-valve 156$c_2$ and the piston 155*p*. In the sample chamber 155*c*, the piston 155*p* is located at the bottom of the sample chamber 155*c*, which is full of the sampled formation fluid, and in the in-flow line 155*ci* the exo-valve 156$c_2$ has been closed. The sample of the formation fluid may be retained in the chamber 155*c* and subsequently brought to the surface for further evaluation. After testing and/or sampling the formation fluid from a subterranean formation station such as, for example, the station 112 in FIG. 2, the isolation valve 154 is opened and operation of the pump 132 may resume. The pump 132 may be subsequently deactivated and the example downhole tool 100 moved to another subterranean formation station for testing and/or sampling including the selective cleaning of sensors and filling of any of the sample chamber 155*a-f* that have not been utilized.

Different sensors, such as, for example, the flow line sensor 172, located above the multi-sample module 150 may be selected for cleaning. For example, after the isolation valve 152 is closed (see FIGS. 2 & 3), the hydraulic pump 132 ceases operation. The closure of the isolation valve 152 stops the unrestricted flow of formation fluid through the flow line 180 located below the lower portion 150*b* to the sample chambers 155*a-f* in the multi-sample module 150, and selects the flow line sensor 172 for cleaning. The formation fluid in the flow line 180 above the isolation valve 152 can flow downwardly to either the upper portion 150*a* or the lower portion 150*b* of the multi-sample module 150, and through any of the in-flow lines 155*ai-fi* to an associated sample chamber 155*a-f*.

Referring again to the upper portion 150*a* of the multi-sample module 150 in FIG. 3, the illustrated operational modes of the sample chambers 155*a*, 155*b* and 155*c* also demonstrate how a sample chamber 155 may be utilized to clean the flow line sensor 172 during a testing and/or sampling of formation fluid at the station 112 of the borehole 110. For example, the sample chamber 155*b* can be activated by opening the exo-valve 156$b_1$ in the in-flow line 155*bi* so that the formation fluid in the flow line 180 displaces the piston 155*p* slightly downwardly in the sample chamber 155*b*. When the exo-valve 156$b_1$ is opened, the low pressure fluid above the piston 155*p* is rapidly compressed due to the much greater pressure of the formation fluid. The opening of the exo-valve 156$b_1$ initially creates a transient high flow rate of formation fluid across or at the sensor surface (not shown) of the selected flow line sensor 172 in the flow line 180. The transient high flow rate of formation fluid cleans or removes contaminants or impurities from the selected sensor 172 to enable more accurate measurements to be accomplished. Although the opening of the exo-valve 156$b_1$ initially creates a transient high flow rate of formation fluid across the selected sensor 172, the compression of the low-pressure fluid above the piston 155*p* in the sample chamber 155*b* results in a diversion of but a small volume of formation fluid into the sample chamber 155*b*. After the initial compression of the low-pressure fluid by the formation fluid above the piston 155*p* in the sample chamber 155*b*, the fluid on the other side of the piston 155*p* flows through the out-flow valve 155*bov* to the wellbore fluid located around the sample chambers 155. Thus, after the initial opening of the exo-valve 156$b_1$ the formation fluid that subsequently fills the sample chamber 155*b* is not affected by the initial transient high flow rate of formation fluid and is representative of the formation fluid being sampled at the subterranean formation station 112.

As described above, when the sample chamber 155*b* is filled with the sampled formation fluid, the exo-valve 156$b_2$ is closed to isolate the sample chamber 155*b* and retain the formation fluid sample. This is illustrated in FIG. 3 by the sample chamber 155*c*, which contains a sample of the formation fluid contained or captured between the closed exo-valve 156$c_2$ and the piston 155*p*. In the sample chamber 155*c*, the piston 155*p* is located at the bottom of the sample chamber 155*c*, which is full of the sampled formation fluid, and in the in-flow line 155*ci* the exo-valve 156$c_2$ has been closed. The sampled formation fluid may be retained in the chamber 155*c* and subsequently brought to the surface for further evaluation. After testing and/or sampling the formation fluid from a subterranean formation station such as, for example, the station 112 in FIG. 2, the isolation valve 152 is opened, and the operation of the pump 132 may resume. The pump 132 may be subsequently deactivated and the example downhole tool 100 moved to another subterranean formation station for testing and/or sampling including the selective cleaning of sensors and filling of any of the sample chambers 155*a-f* that have not been utilized.

Figure 4:
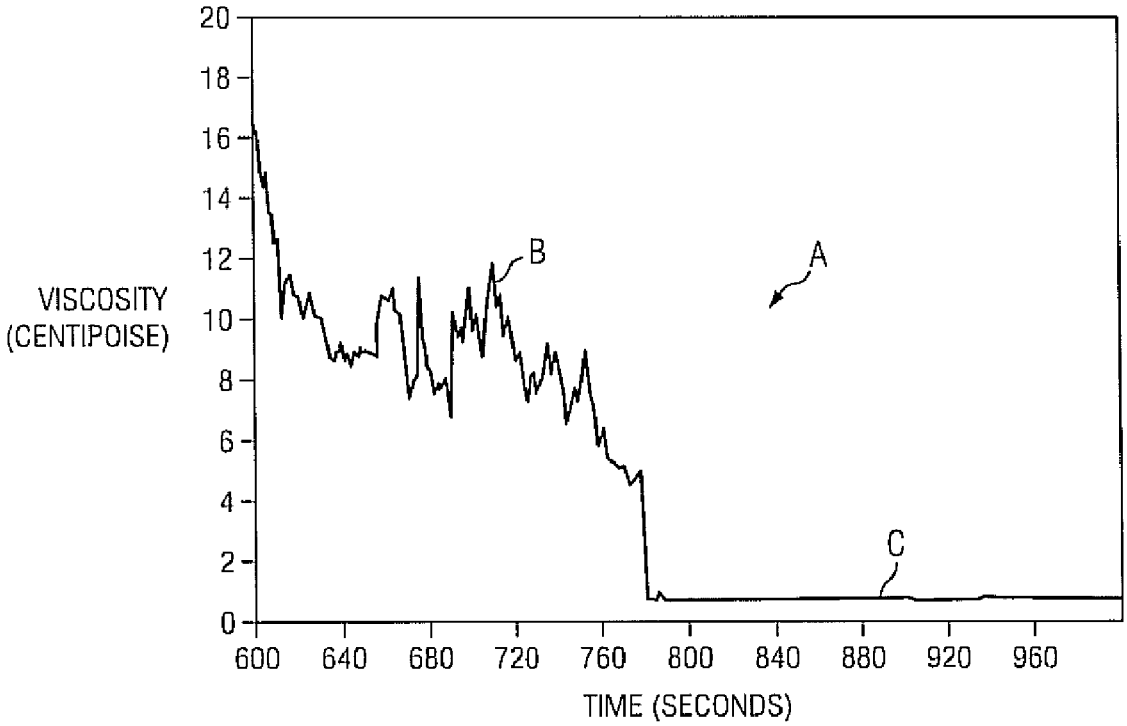
FIG. 4 is a chart illustrating the results of creating a transient high flow rate to remove impurities at a sensor in the example downhole tool illustrated in FIGS. 2 and 3.

The creation of a transient high flow rate of formation fluid across or at one or more selected sensor(s) cleans or removes effectively impurities away from the measuring surfaces of the sensors. FIG. 4 is a chart illustrating the results of creating the transient high flow rate of formation fluid to clean a sensor in a downhole tool such as, for example, the example downhole tool 100 illustrated in FIGS. 2 and 3. A viscometer located in a downhole tool measured the viscosity of a subterranean formation fluid, and a curve A in FIG. 4 represents the measured viscosity. The initial part B of the curve A illustrates a significantly wide range of viscosity values for the formation fluid being analyzed or tested. However, a flow valve was opened for a sample chamber which has a low-pressure fluid between the sample chamber piston and the flow valve (e.g., such as in FIG. 3 illustrating the opened exo-valve 156$b_1$ for the sample chamber 155*b* which has a low-pressure fluid between the piston 155*p* and the exo-valve 156$b_1$). The transient high flow rate of formation fluid created by opening the sample chamber cleaned or removed effectively the impurities away from the measuring or sensing surface of the viscometer which then, at part C of curve A, measured accurately the viscosity of the subterranean formation fluid.

Referring again to FIGS. 2 and 3, the example downhole tool 100 may be operated by other example methods to clean selectively either the sensors 134, 142, 144 or the sensor 172 in the flow line 180. For example, the isolation valve 154 may be closed while the pump 132 continues to operate to transmit formation fluid from the probe 121 through the flow line 180 to the sample chambers 155 of the multi-sample module 150. When an exo-valve such as, for example, the exo-valve 155$b_1$ in the in-flow line 155*bi* of the sample chamber 155*b*, is opened to create initially a transient high flow rate of formation fluid to clean the sensors 134, 142 and 144, the continued operation of the plump 132 can enhance the movement of formation fluid through the flow line 180 and the in-flow line 155*bi*. The operation of the pump 132 during and after the opening of the exo-valve 156$b_1$ in the in-flow line 155*bi* can increase the velocity of the initial high flow rate of formation fluid into the sample chamber 155*b* to remove or clean impurities from the sensing surfaces of the sensors 134, 142 and 144. After the initial high rate of flow of formation fluid into the chamber 155*b*, the pump 132 transmits the formation fluid into the sample chamber 155*b* to move the piston 155*p* downwardly and cause the fluid (e.g., water or buffer fluid) behind the piston 155*p* to move through the out-flow valve 155*bov* to the wellbore fluid located around the sample chambers 155.

An alternate configuration (not shown) of the downhole tool 100 illustrated in FIGS. 2 and 3 may include the pump 132 having its inlet connected to the connecting lines 157*a* and/or 157*b*. The positions of the out-flow valves 155*aov-fov* are changed so that the sample chambers 155*a-f* communicate fluid with the associated connecting lines 157*a* and 157*b*. Thus, when the pump 132 is operating and, as described above, one of the exo-valves 155$a_1$-$f_1$, such as the exo-valve 155$b_1$, is opened, the pump 132 pulls the water or other appropriate fluid from the associated sample chamber 155*b* into the connecting line 157*a* for flow to the outlet valve 176.

Referring again to FIG. 2, the example downhole tool 100 includes the large volume sample chamber 162 in the large sample chamber module 160. The isolation or flow valve 164 is located in a connecting line 165 and is in a closed mode to isolate the large volume sample chamber 162 from the flow line 180. The large volume sample chamber 162 includes a main chamber 166 containing a piston 168 and has a low-pressure fluid such as, for example, air at atmospheric pressure, between the piston 166 and the flow valve 164, and also has a low-pressure fluid at the other side of the piston 166 in the main chamber 166.

The large volume sample chamber 162 of the example downhole tool 100 may be used to clean the sensing surfaces of the sensors 134, 142, 144 and 172 and to retain a sample of the formation fluid in the main chamber 166. The flow valve 164 may be closed and then opened more than one time to create a series of transient high flow rates in the flow line 180. Because the large volume sample chamber 162 can retain a larger volume than one of the sample chambers 155, the flow valve 164 can be cycled open and closed a number of times during the filling of the main chamber 166 with the higher pressure formation fluid.

The example downhole tool 100 may be operated to achieve another example method of cleaning the sensors 134, 142, 144 and 172. As described herein for FIGS. 2 and 3, one of the sample chambers 155*a-f* may be used to create a transient high flow rate of formation fluid when its associated exo-valve 156$a_1$-$f_1$ is opened. However, a series of transient high flow rates may be created by opening serially more than one sample chamber 155*a-f*. For example, in FIG. 3 the sample chamber 155*a* may be used or activated by the opening of its exo-valve 156$a_1$ and, at or before the closure of the exo-valve 155$a_2$ to isolate the chamber 155*a* from the formation fluid in the in-flow line 155*ai*, the exo-valve 156$b_1$ is opened to continue the transient high rate of flow of formation fluid in the flow line 180. In a similar manner, the exo-valve 156$c_1$ for the sample chamber 155*c* may be opened at or before the closure of the exo-valve 156$b_2$ of the sample chamber 155*b*. Thus, a series of the sample chambers 155*a-f* may be utilized serially to create and maintain for a longer period of time the transient high rate of flow of formation fluid in the flow line 180 to clean the sensors 134, 142, 144 and 172.

The opening of the flow valve 164 or an exo-valve 156$a_1$-$f_1$ and the resulting transient high flow rate of formation fluid may create a pressure shock in some subterranean reservoirs and adversely affect the sampling of the formation fluid. In such situations, the main chamber 166 of the large volume sample chamber 162 or the interior of a sample chamber 155*a-f* may contain a fluid that cushions the inward movement of the associated piston 162, 155*p*. A fluid such as, for example, nitrogen may be present within the chamber 162 or the interior of a sample chamber 155*a-f* at a pressure (e.g., such as, for example, above atmospheric pressure) determined to provide a desired rate of piston movement in accordance with the downhole conditions.

Figure 5:
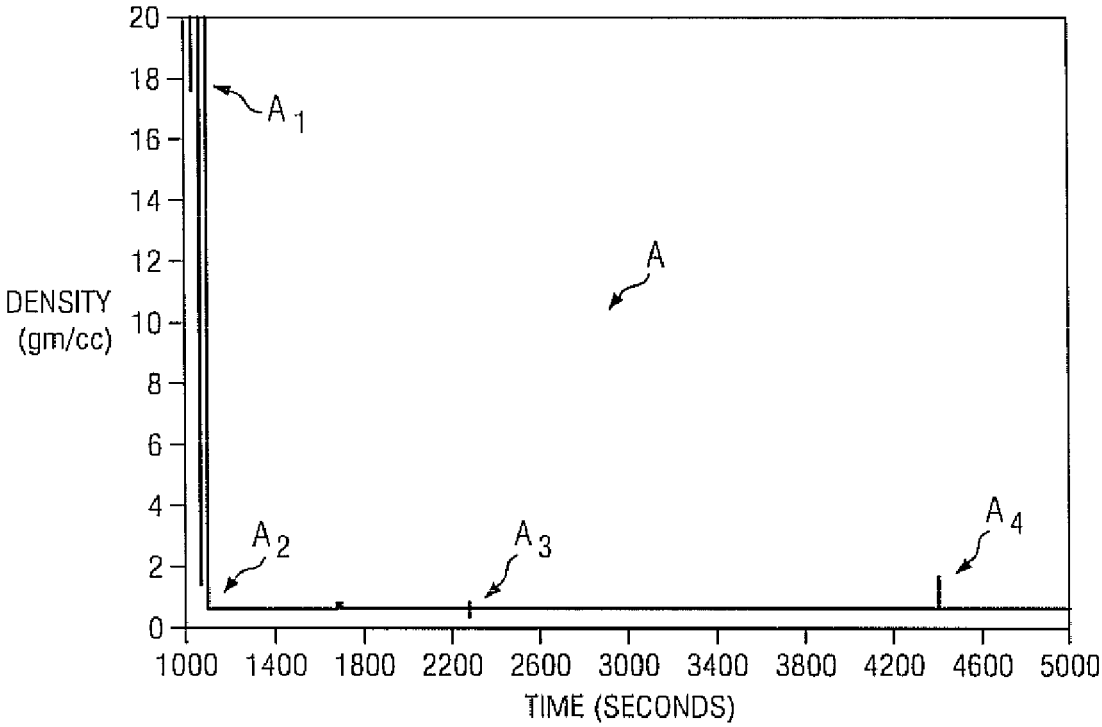
FIG. 5 is a chart illustrating the results of example methods used to create longer transient high flow rates of formation fluid to remove impurities at a downhole sensor.

FIG. 5 is a chart illustrating the results of either repeatedly cycling open and closed the flow valve 164 of the large sample module 160 or utilizing serially more than one sample chamber 155 of the multi-sample chamber module 150, to create for a longer period of time the transient high rate of flow of the formation fluid in the flow line 180. A density sensor, such as the fluid sensor 144 in FIG. 2, was used to measure the density of the formation fluid being tested and/or sampled in a downhole tool such as, for example, the example downhole tool 100. In FIG. 5, the curve A represents the measured density of the formation fluid and includes initially at segment $A_1$ a wide range of density measurements. However, the density sensor operates much more accurately when either a large volume sample chamber such as, for example, the large volume sample chamber 162, is cycled open and closed repeatedly or a series of smaller volume sample chambers such as, for example, the sample chambers 155*a-f*, are opened serially, to create a longer transient high rate of flow of the formation fluid. Points $A_2$, $A_3$ and $A_4$ of curve A represent the measured density at the times a sample chamber is utilized to create a transient high rate of flow of the formation fluid in the flow line 180. As shown in FIG. 5, a longer transient high rate of flow of the formation fluid results in a more accurate measurement of the density of the formation fluid as a result of a longer period of time during which impurities are cleaned from the sensing surfaces of the density sensor 144.

Referring again to FIGS. 2 and 3, the example downhole tool 100 may be operated by another alternative method to clean selectively the sensors 134, 142, 144 and 172 in the flow line 180. For example, the outlet or flow valve 174 may be closed to stop fluid flow through the outlet port 176 while the pump 132 continues to operate to draw formation fluid through the probe 121 and into the flow line 180. The closure of the flow valve 174 subsequently causes the pump 132 to stall (e.g., cease to transmit fluid). The flow line sensors 134, 142 and 172 indicate when the flow of formation fluid in the flow line 180 had ceased. The flow valve 174 can then be opened to flow fluid through the outlet port 176 and create a transient high flow rate of formation fluid across or at the sensing surfaces of the flow line sensors 134, 142, 172 and the fluid sensor 144 (e.g., the fluid sensor 144 being, for example, a density sensor) to remove or clean impurities from the sensing surfaces.

Figure 6:
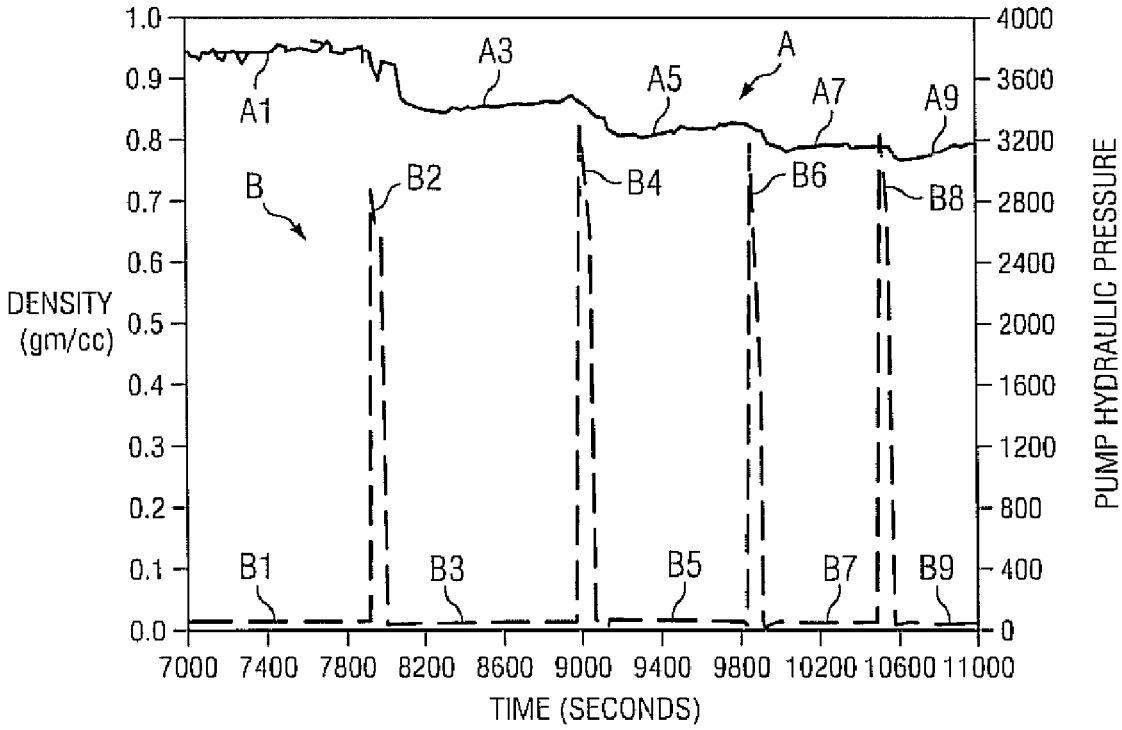
FIG. 6 is a chart illustrating the results of another example method used to create transient high flow rates of formation fluid to remove impurities at a downhole sensor.

FIG. 6 is a chart illustrating the results of the above-described method of closing the flow valve 174 to stall the pump 132 and then opening the flow valve 174 to create a transient high flow rte of formation fluid in the flow line 180 illustrated in FIG. 2. A fluid sensor 144 such as, for example, a density sensor, measured the density of the formation fluid flowing the flow line 180, and the measured density is illustrated as a curve A in FIG. 6. A curve B in FIG. 6 illustrates the pressure created by a hydraulic pump such as, for example, the pump 132 in FIG. 2. The outlet valve 174 is repeatedly closed and then opened to cause at each closing an increase in pressure at and a stalling of the hydraulic pump 132 (see the high hydraulic pressure spikes B2, B4, B6 and B8 of the curve B in FIG. 6) and at each opening a rapid decrease in pressure at the hydraulic pump 132 (see the low hydraulic pressure segments B1, B3, B5, B7 and B9 of the curve B). The low hydraulic pressure segments B3, B5, B7, and B9 correspond to transient high flow rates of formation fluid at the fluid sensor 144, and the density measured by the fluid sensor 144 increasingly improves as shown by the curve segments A3, A5, A7 and A9. The progression of the curve A illustrates that the low hydraulic pressure segments B3, B5, B7, and B9 correspond to the cleaning or removal of impurities from the sensing surface of the fluid analyzer 144, and the measured density at each of the subsequent respective curve segments A3, A5, A7 and A9 is improved.

The method of closing and opening the outlet valve 174 while the pump 132 is operating may also be utilized to clean flow line sensors when either some or all of the low-pressure sample chambers 155 of the multi-sample module 150 have been utilized previously for the testing and/or sampling of formation fluids or a downhole tool does not include low-pressure sample chambers such as, for example, the low-pressure sample chambers 155.

Figure 7:
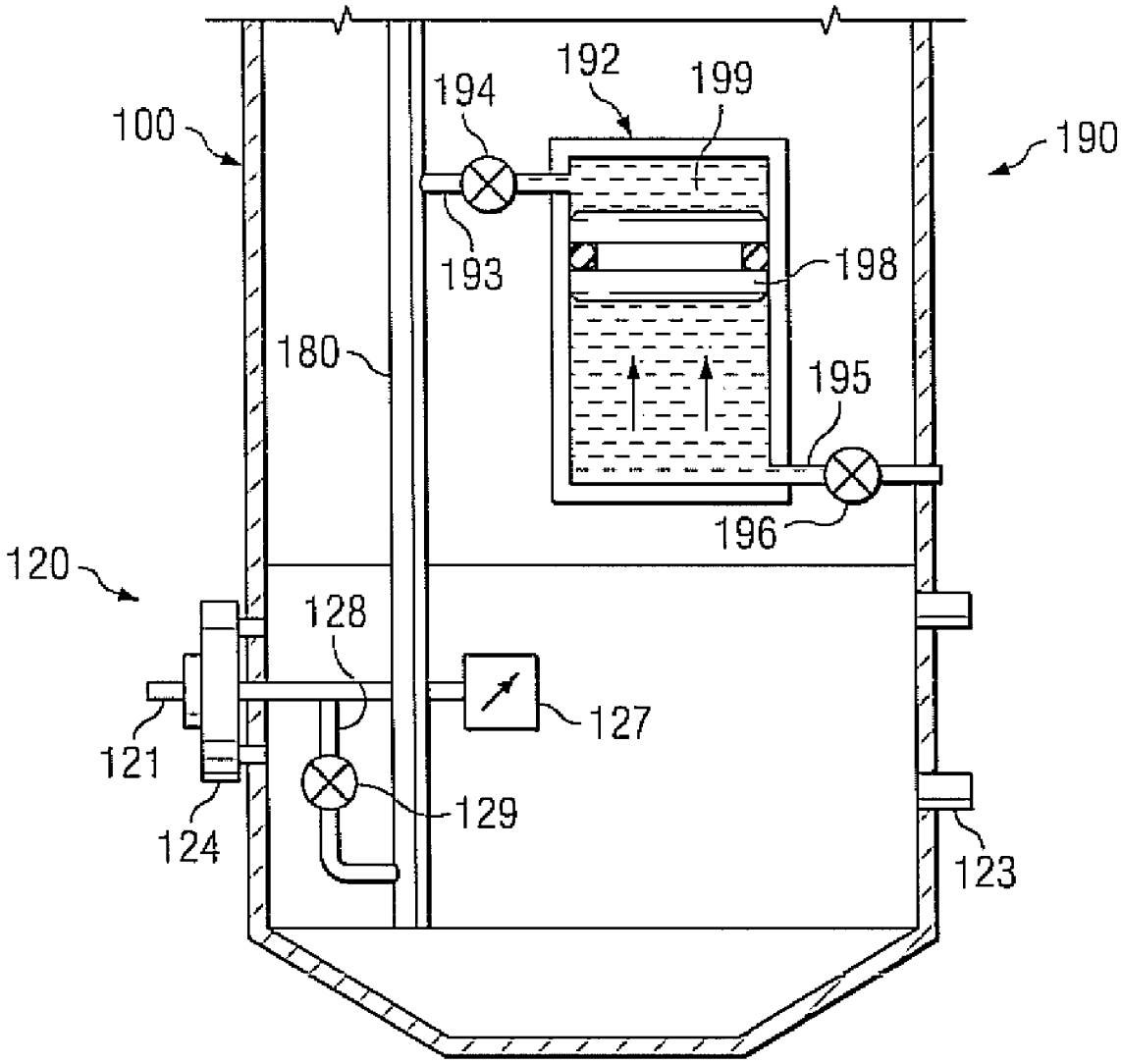
FIG. 7 is a schematic illustration of a large volume sample chamber that may be utilized in the example downhole tool illustrated in FIG. 2.

FIG. 7 is a schematic illustration of another example large volume sample chamber 192 that may be utilized in the example downhole tool 100 illustrated in FIG. 2. The large volume sample chamber 192 is part of a cleaning module 190 that may be located in the example downhole tool 100 at various locations such as, for example, adjacent the probe module 120 as illustrated in FIG. 7. In FIG. 7, the large volume sample chamber 192 is connected to the flow line 180 by a connecting line 193 having an isolation valve 194. An opposite end of the sample chamber 192 is connected to the borehole 110 (see FIG. 2) via a large volume connecting line 195 having a flow valve 196. The flow valve 196 may be opened to permit the high pressure fluid in the borehole 110 to flow into the sample chamber 192 and displace a piston 198 toward the connecting line 193 and the isolation valve 194. Water, detergent, or another appropriate cleaning fluid 199 for cleaning the sensing surfaces of the sensors 134, 142, 172 and 144, is contained on an opposite side of the piston 198 within the sample chamber 192. The cleaning fluid 199 may be contained at either a low pressure or a high pressure within the sample chamber 192.

When it is desired to clean one or more of the sensors 134, 142, 172 and 144 in the flow line 180, the flow valve 196 may be opened to permit the high pressure fluid in the borehole 110 to flow through the connecting line 195 to the sample chamber 192 to displace the piston 198. Concurrently, the isolation valve 194 is opened to permit the cleaning fluid 199 to flow rapidly to the formation fluid in the connecting line 193, the flow line 180 and past the sensors 134, 142, 172 and 144 to the outlet 176. The transient high rate of flow of the formation fluid within the flow line 180 will clean impurities from the sensing surfaces of the sensors 134, 142, 172 and 144. Additionally, or alternatively if the flow rate of the fluid from the borehole 110 is controlled (via partial opening of the flow valve 196) to produce a lower transient rate of flow of formation fluid, the cleaning fluid 199 such as, for example, a detergent, from the sample chamber 192 will loosen or dislodge the impurities at the sensors 134, 142, 172 and 144 to enable the impurities to be removed by the flow of the formation fluid in the flow line 180. Of course, the flow valve 196 and the isolation valve 194 may each be opened and closed more than one time to create a transient high rate of flow of the cleaning fluid 199 and the formation fluid to clean or remove impurities at one or more of the sensors 134, 142, 172 and 144.

Alternatively, if the cleaning fluid 199 is maintained under high pressure in the sample chamber 192 (e.g., not requiring the flow valve 196, the connecting line 195 and the piston 198), then the opening of the isolation valve 194 will permit the cleaning fluid 199 to flow rapidly to the formation fluid in the connecting line 193, the flow line 180 and past the sensors 134, 142, 172 and 144 to the outlet 176. The transient high rate of flow of the formation fluid within the flow line 180 will clean impurities from the sensing surfaces of the sensors 134, 142, 172 and 144.

Figure 8:
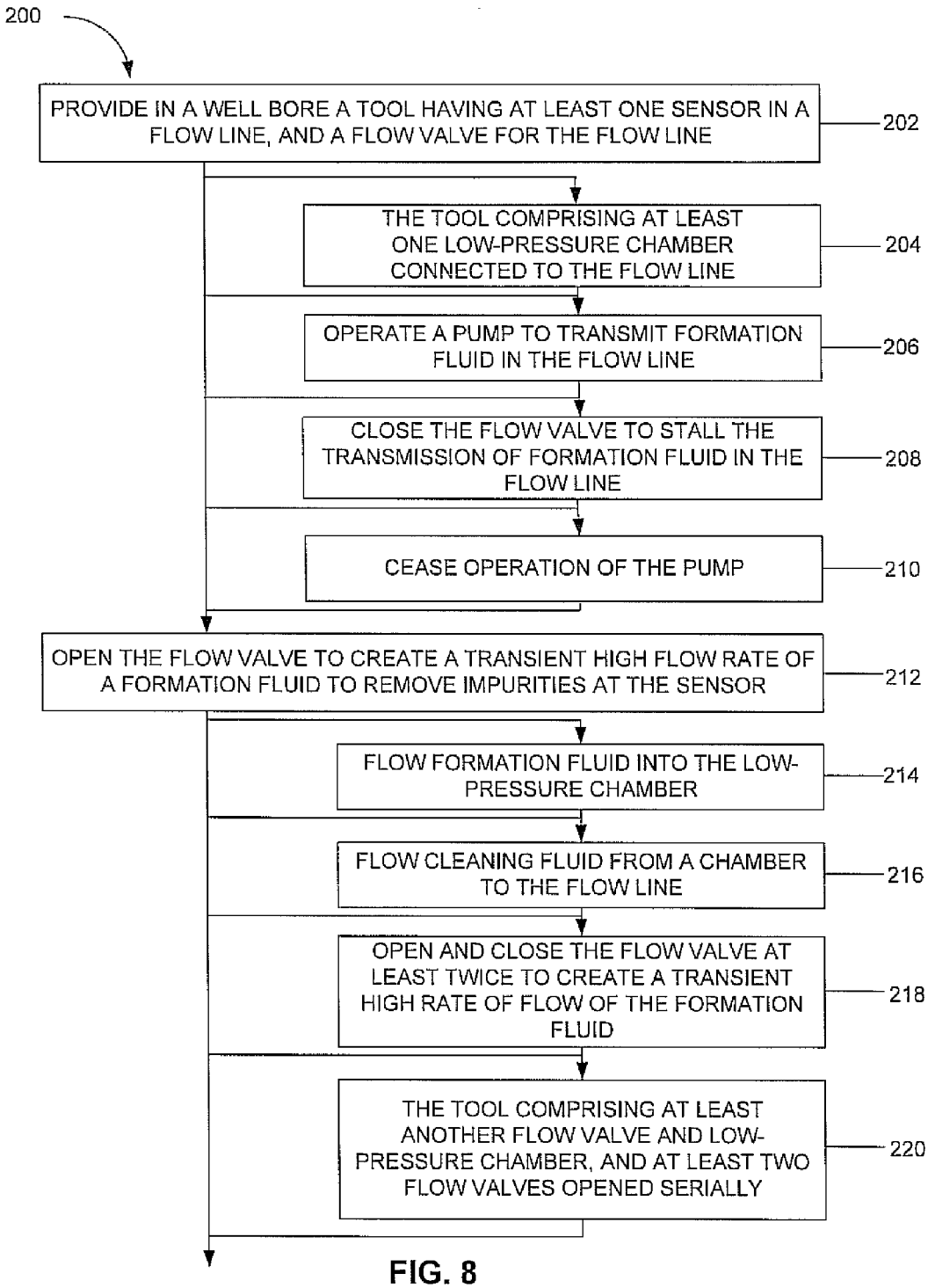
FIG. 8 is a flowchart illustrating an example method to remove impurities at a sensor in a downhole tool.

FIG. 8 is a flowchart illustrating an example method 200 to remove impurities at a sensor in a downhole tool. At block 202, the example method 200 includes providing in a wellbore (e.g., the well bore 110 in FIG. 2) a tool (e.g., the example downhole tool 100 in FIGS. 2 and 7) having at least one sensor for a flow line (e.g., the sensors 134, 142, 172 and 144 in FIG. 2 for the flow line 180 in FIGS. 2, 3 and 7), and a flow valve (e.g., the flow valves 156$a_1$-$f_1$, 156$a_2$-$f_2$ in FIG. 3, the flow valves 164 and 174 in FIG. 2, or the flow valve 196 in FIG. 7) in the flow line. The example method 200 includes options illustrated at blocks 204, 206, 208 and 210. At block 204, the example method 200 includes optionally the tool comprising at least one low-pressure chamber (e.g., the example downhole tool 100 comprising the low-pressure sample chambers 155*a-f* in FIGS. 2 and 3, the large volume sample chamber 164 in FIG. 2, or the large volume sample chamber 192 in FIG. 7) connected to the flow line (e.g., the flow line 180 in FIGS. 2, 3 and 7). A pump (e.g., the pump 132 in FIG. 2) may be operated to transmit formation fluid in the flow line (e.g., the flow line 180 in FIGS. 2, 3 and 7), (block 206). The flow valve (e.g., the flow valve 174 in FIG. 2) may be closed to stall the transmission of the formation fluid in the flow line (e.g., the flow line 180 in FIG. 2), as shown at block 208. The block 210 illustrates the option to cease operation of the pump (e.g., the pump 132 in FIG. 2). At the block 212, the example method 200 then includes the opening of the flow valve (e.g., the flow valves 156$a_1$-$f_1$, 156$a_2$-$f_2$ in FIG. 3, the flow valves 164 and 174 in FIG. 2, or the flow valve 196 in FIG. 7) to create a transient high flow rate of a formation fluid to remove impurities at the sensor (e.g., the sensors 134, 142, 172 and 144 in FIG. 2 for the flow line 180 in FIGS. 2, 3 and 7). The example method 200 then includes options at blocks 214, 216, 218 and 220. At optional block 214, formation fluid is flowed into the low-pressure chamber (e.g., the low-pressure sample chambers 155*a-f* in FIGS. 2 and 3, the large volume sample chamber 164 in FIG. 2, or the large volume sample chamber 192 in FIG. 7). Cleaning fluid (e.g., the cleaning fluid 199 in the large volume sample chamber 192 in FIG. 7) may be flowed from a chamber (e.g., the large volume sample chamber 192 in FIG. 7) to the flow line (e.g., the flow line 180 in FIG. 7), (block 216). At the optional block 218, the flow valve is opened and closed at lest twice (e.g., the flow valves 156$a_1$-$f_1$, 156$a_2$-$f_2$ in FIG. 3, the flow valves 164 and 174 in FIG. 2, or the flow valve 196 in FIG. 7) to create a transient high flow rate of formation fluid. And at the optional block 220, the tool (e.g., the example downhole tool 100 in FIG. 2) comprises at least another flow valve and low-pressure chamber (e.g., the flow valves 156$a_1$-$f_1$, 156$a_2$-$f_2$ in FIG. 3 and the low-pressure sample chambers 155*a-f* in FIGS. 2 and 3), and at least two flow valves (e.g., the flow valves 156$a_1$-$f_1$, 156$a_2$-$f_2$) are opened serially.

Example apparatus and methods to remove impurities from a sensor in an example downhole tool are described with reference to the flowchart illustrated in FIG. 8. However, persons of ordinary skill will readily appreciate that other methods of implementing the example method may alternatively be used. For example, the order of execution of the blocks may be changed, and/or some of the blocks described may be changed, eliminated, or combined.

Although a certain example apparatus and methods have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method, comprising:

positioning a downhole tool in a wellbore penetrating a subterranean formation, wherein the downhole tool comprises:

a flow line;

a sensor in the flow line;

an inlet configured to communicate formation fluid to the sensor;

a chamber connected to the flow line and containing a cleaning fluid;

a first valve connecting the flow line to the chamber; and a second valve connecting the chamber to the wellbore;

opening the first and second valves; and flowing the cleaning fluid to the flow line to remove impurities at the sensor while withdrawing formation fluid from the formation.

2. A method as claimed in claim 1, further comprising subjecting a piston in the chamber to fluid pressure from the wellbore to displace the cleaning fluid when the first and second valves are opened.

3. A method as claimed in claim 1, wherein the downhole tool is configured to be used on a wire line.

4. A method as claimed in claim 1, wherein the downhole tool is configured to be used on a drill string.

* * * * *